United States Patent [19]

Takahashi et al.

[11] Patent Number: 4,943,608

[45] Date of Patent: Jul. 24, 1990

[54] ROSIN EMULSION SIZING AGENT

[75] Inventors: Mizunori Takahashi, Ichihara; Tsuyoshi Ikeda; Yoshiharu Yamaguchi, both of Chiba, all of Japan

[73] Assignee: Dic-Hercules Chemicals, Inc., Tokyo, Japan

[21] Appl. No.: 113,907

[22] Filed: Oct. 29, 1987

[30] Foreign Application Priority Data

Nov. 5, 1986 [JP] Japan ..... 61-261942

[51] Int. Cl.[5] ..... C08L 93/04

[52] U.S. Cl. ..... 524/272; 524/555; 526/304; 526/307.7; 106/238; 106/218

[58] Field of Search ..... 524/272, 555; 526/304, 526/307.7; 106/238, 218

[56] References Cited

U.S. PATENT DOCUMENTS

| | | | |
|---|---|---|---|
| 3,804,788 | 4/1974 | Funaoka et al. | 524/272 |
| 3,925,328 | 12/1975 | Shibahara et al. | 524/272 |
| 4,098,746 | 7/1978 | Becker et al. | 524/272 |
| 4,115,331 | 9/1978 | Tominaga et al. | 524/272 |
| 4,129,539 | 12/1978 | Fakla et al. | 524/272 |
| 4,618,640 | 10/1986 | Tsuchida et al. | 524/272 |
| 4,681,909 | 7/1987 | Ohta et al. | 524/272 |

*Primary Examiner*—John Kight, III
*Assistant Examiner*—Dennis R. Daley
*Attorney, Agent, or Firm*—Oblon, Spivak, McClelland, Maier & Neustadt

[57] ABSTRACT

A rosin emulsion sizing agent comprising a fortified rosin, an at least partially quarternized product copolymer principal consisting of a (meth)acrylic acid alkylaminoalkyl ester or amide monomer and water exhibits excellent sizing effect in a papermaking system of higher pH, higher water hardness and higher temperature, in which conventional anionic rosin emulsion sizing agents cannot effectively function.

16 Claims, No Drawings

ROSIN EMULSION SIZING AGENT

FIELD OF THE INVENTION

This invention relates to a novel rosin emulsion sizing agent.

BACKGROUND OF THE INVENTION

Recently there is an increased trend in the papermaking industry to employ more neutral papermaking systems by reducing use of aluminum sulfate. Also often papermaking must be carried out with water of remarkably high hardness caused by increased use of waste paper and extensive employment of the closed water recycle system (in cases where a large amount of $CaCO_3$ is present as a filler in waste paper), and sometimes the temperature of papermaking system is markedly high.

Conventional rosin emulsion sizing agents are mainly dispersed and stabilized with anionic surfactants and the sizing performance of these sizing agents is markedly lower in papermaking systems as mentioned above. In order to obtain the desired degree of sizing, increased amounts of sizing agents have to be used. Use of excessive amounts of the sizing agent not only raises manufacturing cost but often causes inconveniences in operation such as foaming, formation of pitch, etc. in papermaking systems, and degrades the quality of the produced paper.

U.S. Pat. No. 3,966,654 (corresponding to Japanese Patent Publication No. 58-34509) and British Laying-Open Patent Publication No. 1551645-A (corresponding to Japanese Laying-Open Patent Publication No. 53-12951) disclose some cationic rosin emulsion sizing agents. However, these sizing emulsions are not satisfactory in storage stability and mechanical stability and sizing performance.

The purpose of the present invention is to overcome the above-mentioned defects of conventional rosin emulsion sizing agents, and provide novel useful rosin emulsion sizing agents. We have conducted an intensive study and found that rosin emulsions containing a partially or totally quarternized product of a copolymer of an alkylaminoalkyl ester or alkylaminoalkyl amide of (meth)acrylic (the term "(meth)acrylic" being used to mean "acrylic and/or methacrylic") acid, an alkyl ester of (meth)acrylic acid and/or a styrene compound (meaning styrene or derivatives thereof) are excellent in emulsion stability and exhibit excellent sizing performance when added to papermaking systems of any pH in a wide range from acidic to neutral, and in particular, these emulsions exhibit excellent sizing performance in papermaking systems in which conventional rosin emulsion sizing agents cannot satisfactorily function, that is, in systems of which the pH is almost neutral (that is, containing less aluminum sulfate), the water hardness is high and the temperature is high.

DISCLOSURE OF THE INVENTION

This invention provides:

a rosin emulsion sizing agent consisting essentially of, by weight, (1) from 20 to 50% of a fortified rosin, (2) from 1 to 30% of a partially or totally quarternized product (cationized copolymer) of a copolymer consisting essentially of a. from 20 to 80% by weight of a (meth)acrylic acid alkyl ester monomer of the general formula (I)

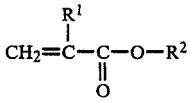

(I)

wherein $R^1$ is H or $CH_3$, and $R^2$ is $C_{1-18}$ alkyl, and/or a styrene compound of the general formula (II)

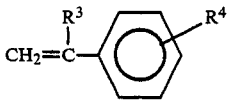

(II)

wherein $R^3$ is H or $CH_3$, and $R^4$ is H or $C_{1-4}$ alkyl; and b. from 20 to 80% by weight of a (meth)acrylic acid alkylaminoalkyl ester or amide monomer of the general formula (III)

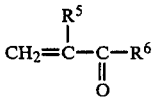

(III)

wherein $R^5$ is H or $CH_3$, and $R^6$ is mono- or di-lower-alkylamino-lower alkoxy or mono- or di-lower-alkylamino-lower alkylamino;

said copolymer having a number average molecular weight of from 1,000 to 500,000; and (3) balance water.

This invention also provides:

a rosin emulsion sizing agent consisting essentially of, by weight, (1) from 20 to 50% of a fortified rosin, (2) from 1 to 30% of a partially or totally quarternized product (cationized copolymer) of a copolymer consisting essentially of a. from 20 to 80% by weight of a (meth)acrylic acid alkyl ester monomer of the general formula (I)

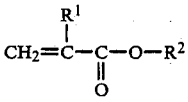

(I)

wherein $R^1$ is H or $CH_3$, and $R^2$ is $C_{1-8}$ alkyl, and/or a styrene compound of the general formula (II)

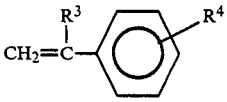

(II)

wherein $R^3$ is H or $CH_3$, and $R^4$ is H or $C_{1-4}$ alkyl;

b. from 20 to 80% by weight of a (meth)acrylic acid alkylaminoalkyl ester or amide monomer of the general formula (III)

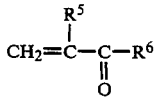

(III)

wherein $R^5$ is H or $CH_3$, and $R^6$ is mono- or di-lower-alkylamino-lower alkoxy or mono- or di-lower-alkylamino-lower alkylamino; and c. from 5 to 20% by weight of a fourth compound of the general formula (IV)

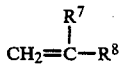

(IV)

wherein $R^7$ is H or $CH_3$ and $R^8$ is CN, lower alkylcarboxy of the formula —$OCOR^{15}$ wherein $R^{15}$ is $C_{1-6}$ alkyl, carbamoyl, mono- or dialkylaminocarboxy of the formula

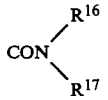

wherein $R^{16}$ is H or $C_{1-2}$ alkyl and $R^{17}$ is $C_{1-2}$ alkyl, or hydroxy-lower alkoxycarbonyl of the formula $COOR^{18}OH$ wherein $R^{18}$ is $C_{1-6}$ alkylene;

said copolymer having a number average molecular weight of from 1,000 to 500,000; and (3) balance water.

Said partially or totally quarternized product of the copolymer of the (meth)acrylic acid alkylaminoalkyl ester or amide monomer, the alkyl (meth)acrylate monomer and/or a styrene compound, optionally containing the vinyl compound is hereinafter called "cationized (meth)acrylic acid alkylaminoalkyl ester or amide copolymer" or simply "cationized copolymer" and said copolymer is called "(meth)acrylic acid alkylaminoalkyl ester or amide copolymer" or simply "copolymer".

The sizing agent of the present invention can be prepared, for instance, by dissolving a fortified rosin in an organic solvent, adding thereto the cationized (meth)acrylic acid alkylaminoalkyl ester or amide copolymer and water, stirring the mixture, treating the mixture at least once with a homogenizer under a pressure of about 70–600 kg/cm$^2$ to make a stable emulsion, and thereafter distilling off the organic solvent under reduced pressure. A cationic or nonionic surfactant can be used in this emulsification as described hereinafter.

The sizing agent of the present invention can also be prepared by phase inversion emulsification. That is, a molten fortified rosin is mixed with the cationized (meth)acrylic acid alkylaminoalkyl ester or amide copolymer in an amount sufficient to form a stable water-in-oil emulsion, water is added to the resulting mixture, the phases are inverted and further water is added to form a stable oil-in-water emulsion. In this case, a small amount of a cationic or nonionic surfactant can be used in combination with the cationized (meth)acrylic acid alkylaminoalkyl ester or amide copolymer as described hereinafter.

The sizing agent of the present invention can also be prepared by mixing a molten fortified rosin, the cationized (meth)acrylic acid alkylaminoalkyl ester or amide copolymer and water at elevated temperature under high pressure, homogenizing the mixture with a homogenizer under high pressure, and thereafter quenching the mixture. In this case, also a cationic or nonionic surfactant can be used in combination as described hereinafter.

The fortified rosin used in the present invention is a product obtained by addition to a rosin of 1–20% by weight, preferably 3–15% by weight of an organic acidic compound containing a

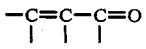

group. Typical rosins from which the fortified rosins are derived are gum rosin, tall oil rosin, wood rosin, etc., which can be used singly or in combination. These rosins can be those which are hydrogenated, polymerized or modified with formaldehyde, etc. Typical examples of said organic acidic compounds are fumaric acid, maleic acid, maleic anhydride, itaconic acid, itaconic anhydride, citraconic acid, citraconic anhydride, acrylic acid, methacrylic acid, etc. Non-fortified rosin can be used in combination with fortified rosin.

The cationized (meth)acrylic acid alkylaminoalkyl ester or amide copolymer, which is a component of the sizing agent of the present invention, has a number average molecular weight of 1,000–500,000, preferably 1,000–100,000, more preferably 1,000–50,000, and is partially or totally quarternized in order for said copolymer to exhibit good emulsifiability and dispersibility and to impart good mechanical stability to said sizing agent.

The (meth)acrylic acid alkyl ester monomer, which is a constituent of the (meth)acrylic acid alkylaminoalkyl ester or amide copolymer, is at least one monomer represented by the general formula (I)

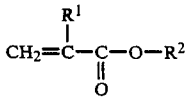

(I)

wherein $R^1$ is H or $CH_3$ and $R^2$ is $C_{1-18}$ alkyl.

The styrene compound is at least a monomer represented by the general formula (II)

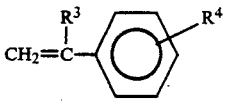

(II)

wherein $R^3$ is H or $CH_3$, $R^4$ is H or $C_{1-4}$ alkyl.

The (meth)acrylic acid alkylaminoalkyl ester or amide monomer is at least one monomer of the general formula (III)

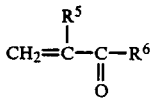

(III)

wherein $R^5$ is H or $CH_3$, $R^6$ is lower-alkylamino-lower alkoxy of the formula

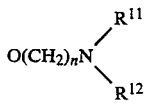

wherein $R^{11}$ is H or $C_{1-2}$ alkyl, $R^{12}$ is $C_{1-2}$ alkyl, and n is an integer of 1 to 6 or lower alkylamino-lower alkylamino of the formula

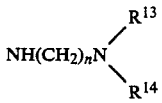

wherein $R^{13}$ is H or $C_{1-2}$ alkyl, $R^{14}$ is $C_{1-2}$ alkyl, and n is an integer of 1 to 6.

If desired, a fourth vinyl monomer represented by the general formula (IV)

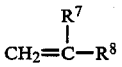

(IV)

wherein $R^7$ is H or $CH_3$ and $R^8$ is CN, lower alkylcarboxy of the formula —$OCOR^{15}$ wherein $R^{15}$ is $C_{1-16}$ alkyl, carbamoyl, mono- or dialkylaminocarboxy of the formula

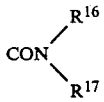

wherein $R^{16}$ is H or $C_{1-2}$ alkyl and $R^{17}$ is $C_{1-2}$ alkyl, or hydroxy-lower alkoxycarbonyl of the formula $COOR^{18}OH$ wherein $R^{18}$ is $C_{1-6}$ alkylene, can be used as a constituent of the (meth)acrylic acid alkylaminoalkyl ester or amide copolymer.

Preferably, $R^2$ is selected from $CH_3$, $C_2H_5$, $C_3H_7$, $C_4H_9$, $C_1H_{13}$, $C_{12}H_{25}$ and $C_{18}H_{37}$; $R^4$ is selected from H, $CH_3$, $CH(CH_3)_2$ and $C(CH_3)_3$; $R^6$ is selected from $O(CH_2)_nN(CH_3)_2$, $O(CH_2)_nN(C_2H_5)_2$, $NH(CH_2)_nN(CH_3)_2$ and $NH(CH_2)_nN(C_2H_5)_2$, n being an integer of 1 to 6; and $R^8$ is selected from CN, $OCOCH_3$, $OCOC_2H_5$, $OCOC_3H_7$, $OCOC_4H_9$, $CONH_2$, $CONHCH_3$, $CONHC(CH_3)_3$ and $COOCH_2CH_2OH$.

Examples of alkyl acrylates and methacrylates of the general formula (I) include methyl-, ethyl-, propyl-, butyl-, octyl-, lauryl- and stearyl acrylates and methacrylates.

Examples of styrene compounds of the general formula (II) include styrene, α-methylstyrene, vinyltoluene, propenyltoluene, vinyl-isopropylbenzene, propenyl-isopropylbenzene, vinyl-t-butylbenzene and propenyl-t-butylbenzene.

Examples of alkylaminoalkyl esters and amides of acrylic and methacrylic acids of the general formula (3) N,N-dimethylaminomethyl-, N,N-diethylaminomethyl-, N-methylaminomethyl-, N-ethylaminomethyl-, N,N-dimethylaminoethyl-, N,N-diethylaminoethyl-, N-methylaminoethyl-, N-ethylaminoethyl-, N,N-dimethylaminopropyl-, N,N-diethylaminopropyl-, N-methylaminopropyl-, N-ethylaminopropyl-, N,N-dimethylaminobutyl-, N,N-diethylaminobutyl-, N-methylaminobutyl-, N-ethylaminobutyl, N,N-dimethylaminopentyl, N,N-diethylaminopentyl, N-methylaminopentyl, N-ethylaminopentyl, N,N-dimethylaminohexyl, N,N-diethylaminohexyl-, N-methylaminohexyl-, and N-ethylaminohexyl acrylates and methacrylates; and N-(dimethylaminomethyl)-, N-(diethylaminomethyl)-, N-(methylaminomethyl)-, N-(ethylaminomethyl)-, N-(dimethylaminoethyl)-, N-(diethylaminoethyl)-, N-(methylaminoethyl)-, N-(ethylaminoethyl)-, N-(dimethylaminopropyl)-, N-(diethylaminopropyl)-, N-(methylaminopropyl)-, N-(ethylaminopropyl)-, N-(dimethylaminobutyl)-, N-(diethylaminobutyl)-, N-(methylaminobutyl)-, N-(ethylaminobutyl)-, N-(dimethylaminopentyl)-, N-(diethylaminopentyl), N-(methylaminopentyl), N-(ethylaminopentyl), N-(dimethylaminohexyl)-, N-(diethylaminohexyl)-, N-(methylaminohexyl)- and N-(ethylaminohexyl)-acrylamides and -methacrylamides.

Examples of vinyl compounds of the general formula (IV) include acrylonitrile and methacrylonitrile; vinyl- and propenyl-acetate, -propionate, -butyrate and -valerate; acrylamide, methacrylamide, and N-methyl- and N,N-dimethyl-acrylamide and -methacrylamide; and 2-hydroxyethyl acrylate and methacrylate.

In the cationized (meth)acrylic acid alkylaminoalkyl ester or amide copolymer, the second component of the rosin emulsion sizing agent of the present invention, namely the (meth)acrylic acid alkylaminoalkyl ester or amide constituent should be contained in an amount of 20–80% by weight, preferably 25–75% by weight, more preferably 30–70% by weight of the copolymer. This is the principal constituent of the copolymer, which exercises the specific function of providing the copolymer with the ability to sufficiently disperse the rosin material when the copolymer is quarternized and greatly contributes to improvement of the storage stability and mechanical stability of the formed emulsion. The content of this constituent in the copolymer is crucial, and the above-mentioned function is exhibited only in the above-described content range and the cationized copolymer does not exhibit this function outside of the above-described range. This constituent, when quarternized, cationizes the resulting copolymer. Because of this cationization, the rosin emulsion sizing agent of the present invention exhibits excellent sizing performance in papermaking systems in which the function of conventional anionic rosin emulsion sizing agents deteriorates, such as systems wherein the content of aluminum sulfate is low (that is, the pH is close to neutral), the hardness of the water medium is high, or the temperature is high.

The (meth)acrylic acid alkyl ester or the styrene compound constituent in aid copolymer should be contained in an amount of 20–80% by weight, preferably 25–75% by weight, more preferably 30–70% by weight. The proportion of the two constituents can be determined as desired, and only one of the two may suffice. This constituent constitutes a hydrophilic moiety of the cationized (meth)acrylic acid alkylaminoalkyl ester or amide copolymer which makes said cationized copolymer function as an emulsifier-dispersant for rosin materials. With a content of less than 20% by weight, the resulting cationized copolymer is excessively hydrophilic and thus does not satisfactorily function as an emulsifier-dispersant. When the content thereof is in excess of 80% by weight, said resulting cationized copolymer is excessively hydrophobic and also does not function well. The proportion of the (meth)acrylic acid alkyl ester and the styrene compound can be determined as desired by considering the proportion of the hydrophobic moiety and the hydrophilic moiety of the resulting cationized (meth)acrylic acid alkylaminoalkyl ester or amide copolymer. Even when only one of the two is used, the cationized (meth)acrylic acid alkylaminoalkyl ester or amide copolymer fully capable of functioning as an emulsifier-dispersant.

The proportion of the hydrophobic moiety in the cationized (meth)acrylic acid alkylaminoalkyl ester or amide copolymer greatly influences storage stability and mechanical stability of the resulting rosin emulsion. Therefore, the content range of the (meth)acrylic acid alkyl ester and/or the styrene compound is limited as defined above. It is considered that the presence of this hydrophobic moiety contributes to improvement of the sizing performance.

The vinyl monomer, a fourth vinyl monomer constituent of the cationized (meth)acrylic acid alkylaminoalkyl ester or amide copolymer, improves the emulsifying-dispersing property of said cationized copolymer. It should be contained in an amount of 5–20% by weight, preferably 5–10% by weight, more preferably 5–7% by weight of the uncationized copolymer. This constituent subtly influences the hydrophilicity-hydrophobicity balance of the cationized copolymer and improves the emulsifying-dispersing property of said cationized copolymer. For this purpose, this constituent should be contained in an amount of at least 5% by weight. On the other hand, when the content thereof exceeds 20%, the emulsifying-dispersing performance of the cationized copolymer decreases.

The molecular weight of the copolymer should be 1,000–500,000. The emulsifying-dispersing ability of the cationized copolymer is low outside of this range. The molecular weight is preferably 1,000–100,000 and more preferably 1,000–50,000.

The cationized (meth)acrylic acid alkylaminoalkyl ester or amide copolymer, which is a component of the sizing agent of this invention, can be prepared by copolymerizing the above-mentioned monomers and quarternizing the resulting copolymer with a quarternizing reagent such as epihalohydrin, alkyl halide, dialkyl sulfate, lactone, etc. The cationized (meth)acrylic acid alkylaminoalkyl ester or amide copolymer can also be prepared by using partially or totally quarternized (meth)acrylic acid alkylaminoalkyl ester or amide monomer. The degree of quarternization is determined with consideration to the emulsifying and dispersing ability of said cationized copolymer, storage stability, sizing performance, etc. required of the resulting rosin emulsion sizing agent, and pH, water hardness, temperature, etc. of papermaking system employed. The degree of quarternization is 50–100%, preferably 60–100%, more preferably 70–100%. A higher degree of quarternization is preferred for papermaking systems having low aluminum sulfate content (that is, of higher pH), high water hardness and high temperature.

The copolymerization reaction is effected by solution polymerization using toluene, isopropyl alcohol, etc. as a solvent. In the polymerization, at least one chain transfer agent selected from among carbon tetrachloride, carbon tetrabromide, cumene, thioglycolic esters, mercaptanes, etc. in accordance with reaction conditions in an amount up to 5% by weight of the monomer mixture in order to control molecular weight of the resulting copolymer. An oil-soluble initiator such as a peroxide, benzoyl peroxide for instance; or an azo compound, azobisisobutyronitrile for instance, is used in an amount of 0.1–3 mole percent of the monomer mixture. The copolymerization reaction proceeds by heating a mixture comprising monomers, a chain transfer agent, a polymerization initiator and a solvent (the content of the monomers is preferably 20–80% by weight) to 60°–150° C., and thus a desired (meth)acrylic acid alkylaminoalkyl ester or amide copolymer can be obtained.

The thus formed (meth)acrylic acid alkylaminoalkyl ester or amide copolymer is quarternized by adding to the obtained polymerization solution containing said formed copolymer an acid such as hydrochloric acid, acetic acid, etc. in an amount equimolar with said formed copolymer and a suitable amount of water to form an oil-in-water emulsion, removing the solvent, and then reacting said formed copolymer with 0.5–2 times the molar equivalent to said copolymer of a quarternizing agent such as epihalohydrin, alkyl halide, etc. at a temperature suitable for the quarternizing agent employed.

The sizing agent of the present invention basically comprises 20–50% by weight of a fortified rosin, 1–30% by weight of the cationized (meth)acrylic acid alkylaminoalkyl ester or amide copolymer, and water. The content of the cationized copolymer in the rosin emulsion should be in a range enabling the resulting emulsion to remain stable for a long period of time, to be stable against shearing force applied during addition to or in a papermaking system, and to function satisfactorily as a sizing agent. In order for the emulsion to have satisfactory stability as an emulsion, the solid content should be not more than 55% by weight, preferably not more than 50%. The proportion of the cationized (meth)acrylic acid alkylaminoalkyl ester or amide copolymer in the solid content is not less than 2% by weight, preferably not less than 3% by weight; and when stability against shearing force is considered, it is not less than 5%. From the viewpoint of production and transportation cost, higher solid content, preferably not less than 20% by weight, and more preferably not less than 30% by weight is preferred. In order for the sizing agent to satisfactorily function as a sizing agent, the content of the fortified rosin should be not less than 50% by weight, and more preferably not less than 70% by weight.

The sizing agent of the present invention may contain a suitable amount of cationic or nonionic surfactant, if desired. Examples of such surfactants are tetraalkylammonium chloride, trialkylbenzylammonium chloride, alkylamine acetate, alkylamine hydrochloride, oxyethylene alkylamine, polyoxyethylene alkylamine, etc. as cationic surfactants; and polyoxyethylene alkyl ether, polyoxyethylene alkylphenyl ether, polyoxyethylene styrylphenyl ether, fatty acid ester of polyoxypropylene polyoxyethyleneglycol glycerine, fatty acid ester of sorbitol, fatty acid ester of polyoxyethylene sorbitol, fatty acid ester of polyoxyethylene sorbitol, fatty acid ester of sugar, fatty acid ester of pentaerythritol, fatty acid ester of propylene glycol, fatty acid diethanolamide, etc. as nonionic surfactants.

The sizing agent of the present invention may further contain various known conventional additives, such as cationic or anionic poly(acrylamide), polyalkylene polyamide epichlorohydrin resin, cationized starch, carboxymethyl cellulose, etc.

Even without the aid of the above-described surfactants, which are optional components, the sizing agent of the present invention is provided with excellent stability as an emulsion. From this fact, it is apparent that the cationized (meth)acrylic acid alkylaminoalkyl ester or amide copolymer, which is a principal component of the sizing agent of the present invention, plays an important role in stabilizing the emulsion.

DESCRIPTION OF EMBODIMENTS OF THE INVENTION

The invention will now be specifically illustrated by way of working examples. The term "parts" referred to in the following examples is based on weight.

Reference Examples 1–3 illustrate preparation of fortified rosins.

REFERENCE EXAMPLE 1

To a melt of 93 parts of formaldehyde-modified tall oil rosin (degree of modification: 3%) maintained at about 200° C., 7 parts of fumaric acid was slowly added. After the reaction was allowed to proceed at said temperature until substantially all of the fumaric acid reacted, the reaction mixture was cooled to room temperature.

The thus obtained reaction product (fortified rosin) was rosin containing 7% of fumaric acid added thereto.

REFERENCE EXAMPLE 2

To a melt of 93 parts of gum rosin maintained at about 160° C., 7 parts of maleic anhydride was slowly added. After substantially all of the maleic anhydride reacted, the reaction mixture was cooled to room temperature. The reaction product (fortified rosin) was a rosin containing 7% of maleic anhydride added thereto.

REFERENCE EXAMPLE 3

To a melt of 46 parts of gum rosin maintained at about 200° C., 7 parts of fumaric acid was slowly added. After substantially all of the fumaric acid had reacted, 47 parts of formaldehyde-modified tall oil rosin (degree of modification: 3%) was added, and the resultant melt was throughly mixed by agitation and cooled to room temperature. The thus obtained reaction product (fortified rosin) was a rosin containing 7% of fumaric acid added thereto.

Reference Examples 4–6 illustrate preparation of various cationized copolymers.

REFERENCE EXAMPLE 4 (AND 5 AND 6)

A mixture of 70 parts of t-butyl methacrylate (this was replaced with 35 parts of t-butyl methacrylate and 35 parts of styrene in Reference Example 5, and with 70 parts of styrene in Reference Example 6), 30 parts of N,N-dimethylaminoethyl methacrylate, 1–2 parts of azobisisobutyronitrile and isopropyl alcohol in an amount to make the monomer concentration 50% by weight, was heated at 70° C. for 6 hours under stirring.

To the reaction mixture, an equimolar amount, based on the amount of the N,N-dimethylaminoethyl methacrylate, of acetic acid was added. Thereafter water in an amount to make the solid content of the cationized copolymer aqueous solution 30% by weight was added to form an oil-in-water emulsion. By this procedure, the temperature of the emulsion dropped. The isopropyl alcohol and some of the water in the emulsion were removed azeotropically by heating the emulsion to approximately 100° C.

After the mixture was cooled to about 50° C., an equimolar amount, based on the amount of the N,N-dimethylaminoethyl methacrylate, of epichlorohydrin was dropwise added to the mixture as the temperature of the mixture was raised, and the resulting mixture was maintained at 80° C. for 1.5 hours to complete quarternization. The solid content was adjusted to 25% by addition of water.

The viscosity of the thus obtained aqueous solution of the cationized copolymer was 220 cps (270 cps in Reference Example 5 and 330 cps in Reference Example 6) when measured at 25° C. with a Brookfield type viscometer. Reference Example 7 (and 8 and 9)

A mixture of 30 parts (50 parts in Reference Example 8, and 70 parts in Reference Example 9) of 2-ethylhexyl acrylate, 70 parts (50 parts in Reference Example 8, and 30 parts in Reference Example 9) of N-(dimethylaminopropyl) methacrylamide, 2 parts of t-dodecyl mercaptan, 2–3 parts of benzoyl peroxide and toluene in an amount to make the total concentration of the monomers, chain transfer agent and initiator 60% by weight, were mixed and the mixture was heated at 100° C. for 5 hours under stirring.

To the reaction mixture were added water in an amount to make an aqueous solution of the cationized copolymer of a solid content of about 30% by weight and an equimolar amount, based on the N-(dimethylaminopropyl) methacrylamide, of dimethyl sulfate, and the mixture was allowed to react at 40° C. for 4 hours. The toluene and some of the water in the reaction mixture were azeotropically removed by heating the mixture to about 100° C. The solid content was adjusted to 25% by addition of water.

The viscosity of the obtained aqueous solution of the cationized copolymer was 1050 cps (530 cps in Reference Example 8, and 110 cps in Reference Example 9), when measured at 25° C. with a Brookfield type viscosimeter. Reference Example 10 (and 11)

The procedures of Reference Example 8 were repeated except that 50 parts of 2-ethylhexyl acrylate was replaced with 25 parts of 2-ethylhexyl acrylate and 25 parts of styrene (with 50 parts of styrene in Reference Example 11).

The viscosity of the obtained aqueous solution of the cationized copolymer was 820 cps (600 cps in Reference Example 11) when measured at 25° C. with a Brookfield type viscosimeter.

REFERENCE EXAMPLE 12 (AND 13 AND 14)

A mixture of 10 parts of methyl methacrylate (lauryl methacrylate in Reference Example 13, and stearyl methacrylate in Reference Example 14), 40 parts of t-butylstyrene (isopropylstyrene in Reference Example 13, and α-methylstyrene in Reference Example 14), 45 parts of N-(dimethylaminopropyl)acrylamide, 5 parts of vinyl acetate (methacrylonitrile in Reference Example 13, and N,N-dimethylacrylamide in Reference Example 14), 0.5 part of carbon tetrachloride, 1–2 parts of azobisisobutyronitrile and isopropyl alcohol in an amount to make the total content of the monomers, chain transfer agent and initiator 50% by weight were mixed and the mixture was heated at 80° C. for 5–6 hours under stirring.

To the reaction mixture was added an equimolar amount, based on the employed N-(dimethylaminopropyl)acrylamide, of acetic acid, and further water was added in an amount to make the solid content of the aqueous solution of the cationized copolymer 30% by weight, to form an oil-in-water emulsion. By this procedure the temperature dropped. The isopropyl alcohol and some of the water in the emulsion were azeotropically removed by heating the emulsion to about 100° C.

The mixture was cooled to room temperature. An equimolar amount, based on the employed N-(dimethylaminopropyl)acrylamide, of methyl iodide was added to the mixture, and the mixture was allowed to react for 3 hours at room temperature. After the reaction was finished, the solid content of the reaction mixture was adjusted to 10% by addition of water.

The viscosity of the thus obtained aqueous solution of the cationized copolymer was 70 cps (80 cps in Reference Example 13, and 100 cps in Reference Example 14) when measured at 25° C. with a Brookfield type viscosimeter.

REFERENCE EXAMPLE 15 (AND 16)

The procedures of Reference Example 12 were repeated except that 0.75 molar equivalent (0.5 molar equivalent in Reference Example 16), based on the employed N-(dimethylaminopropyl)acrylamide, of methyl iodide was used.

The viscosity of the obtained aqueous solution of the cationized copolymer was 60 cps (55 cps in Reference Example 16) when measured at 25° C. with a Brookfield type viscosimeter.

REFERENCE EXAMPLE 17

This example illustrates preparation of a cationic aminopolyamide-epichlorohydrin resin used in Control Example 3.

Following Example A of U.S. Pat. No. 3,966,654, a cationic aminopolyamide-epichlorohydrin resin was prepared as described below.

To 151.3 parts of diethylenetriamine placed in a flask equipped with a stirrer and a condenser for collecting vaporised water, 219.3 parts of adipic acid was slowly added under stirring. The content in the flask was heated at 170°-180° C. in a nitrogen atmosphere until the formation of aminopolyamide was completed. The reaction mixture was allowed to cool down to about 140° C., and hot water was added thereto under stirring to make the solid content 50% (the intrinsic viscosity of the solution diluted to 2% with 1N $NH_4Cl$ was 0.14). To about 50 parts of a 50% solution the aminopolyamide was added about 110.25 parts of water and then 14 parts (0.157 mole) of epichlorohydrin to prepare an epichlorohydrin derivative of the aminopolyamide. The reaction mixture was heated at 70° C. under refluxing until Gardener viscosity of E to F was attained. The solution was diluted with water to a solid content of about 12.5%.

Examples 1-13 and Control Examples 1-4 illustrate preparation of emulsion sizing agents.

EXAMPLE 1 (AND 2 AND 3)

To a melt of 225 parts of the fortified rosin of Reference Example 1 maintained at about 150° C., 200 parts of the aqueous solution (50 parts as solid) of the cationized copolymer of Reference Example 4 (Reference Example 5 in Example 2, and Reference Example 6 in Example 3) was added under vigorous agitation to produce a water-in-oil emulsion. It was inverted at 95° C. to an oil-in-water emulsion by slowly adding hot water thereto. The emulsion was diluted with hot water to a total solid content of 40% by weight to provide a stable oil-in-water emulsion, which was cooled to room temperature.

The thus obtained aqueous emulsion was stable for a prolonged period of time (more than one month).

EXAMPLE 4 (AND 5, 6, 7 AND 8)

A mixture of 212.5 parts of the maleic-anhydride-fortified rosin of Reference Example 2, 140 parts of the aqueous solution of the cationized copolymer (35 parts of solid) of Reference Example 7 (Reference Example 8 in Example 5, Reference Example 9 in Example 6, Reference Example 10 in Example 7, and Reference Example 11 in Example 8), 2.5 parts of lauryltrimethylammonium chloride and water in an amount to make the total solid content 40% by weight, was heated to about 150° C., stirred vigorously and immediately passed through an industrial scale homogenizer, and rapidly cooled to room temperature.

The thus prepared emulsion was stable for a prolonged period of time (more than one month).

EXAMPLE 9 (AND 10, 11, 12 AND 13)

Two hundred and fifty (250) parts of the fumaric-acid-fortified rosin prepared in Referance Example 3 was dissolved in 250 parts of toluene. The solution was admixed with 500 parts of the 10% aqueous solution of the cationized copolymer (50 parts as solid) of Reference Example 12 (Reference Example 13 in Example 10, Reference Example 14 in Example 11, Reference Example 15 in Example 12, and Reference Example 16, in Example 13) and 200 parts of water, and the mixture was maintained at 45° C. for 30 minutes to provide an oil-in-water emulsion.

The emulsion was passed twice through an industrial scale homogenizer under the pressure of 200 $Kg/cm^2$. Finally, substantially all of the toluene was removed from the emulsion by distillation under reduced pressure.

The thus obtained emulsion was stable for a long period of time (more than one month).

CONTROL EXAMPLE 1

A mixture of 250 parts of a fumaric-acid-fortified rosin of Reference Exmaple 1, 20 parts of a 30% sodium dodecylbenzenesulfonate aqueous solution, 460 parts of water was heated to about 170° C., passed through an industrial scale homogenizer under the pressure of about 300 $Kg/cm^2$ to provide an oil-in-water emulsion, which was immediately cooled to room temperature.

The thus obtained emulsion was stable for a prolonged period of time (more than one month).

CONTROL EXAMPLE 2

A melt of 250 parts of fumaric-acid-fortified rosin of Reference Example 3 of about 150° C. was admixed with a small amount of water and cooled to about 130° C. It was then admixed with 50 parts of 20% ammonium salt of polyoxyethylene (of the polymerization degree of 12) octylphenyl either sulfate to provide a water-in-oil emulsion. It is inverted to an oil-in-water emulsion by slowly adding hot water thereto. The emulsion was rapidly diluted with hot water to provide a stable oil-in-water emulsion, which was cooled to room temperature. The amount of hot water used for the inversion and dilution was 350 parts in total.

The thus obtained emulsion was stable for a prolonged period of time (more than one month).

CONTROL EXAMPLE 3

Following Example 1 of U.S. Pat. No. 3,966,654, a rosin emulsion was prepared as follows.

Three hundred (300) parts of the fumaric-acid-fortified rosin of Reference Example 3 was dissolved in 300 parts of benzene. This solution was admixed with 400 parts of the aminopolyamide-epichlorohydrin resin solution (50 parts as solid) prepared in Reference Example 17 and 350 parts of water. The mixture was passed twice through an industrial scale homogenizer under a pressure of about 150 Kg/cm$^2$, followed by removal of the benzene from the emulsion by distillation under reduced pressure. The thus obtained emulsion contained 35% of solid, which was comprised of about 85% of the fortified rosin and about 15% of the aminopolyamide-epichlorohydrin resin.

CONTROL EXAMPLE 4

Following Example 2 of British Laying-Open Patent Specification No. 155164A (Japanese Laying-Open Patent Publication No. 53-12951), a rosin emulsion was prepared as follows.

Two hundred (200) parts of the fumaric-acid-fortified rosin of Reference Example 3 was admixed with 9.2 parts of dimethyldistearylammonium chloride and water in an amount to make 1000 parts. The mixture was heated to 173° C. and homogenized under a pressure of 200 to 220 Kg/cm$^2$. The thus obtained dispersion was rapidly cooled to 25° C. It contained about 21.2% of solid.

EVALUATION OF SIZING PERFORMANCE OF EMULSION SIZING ANGENTS

Using the sizing agents prepared in Examples and Control Examples, hand-sheets were prepared for testing the sizing performance. The procedures and conditions employed were as follows.

TEST 1

Bleached kraft pulp (1:4 mixture of soft wood pulp and hard wood pulp) was beated to a Canadian standard freeness of 350 ml with water in an amount to provide a pulp slurry of a consistency of 2.5% by weight. The water used had a hardness of 100 ppm of 1,500 ppm.

One point two (1.2) liters of said pulp slurry was taken in a size crock, a prescribed amount of the emulsion to be tested and aluminum sulfate were simutaneously added thereto and the pH of the slurry was adjusted to a prescribed value. Thereafter the slurry was agitated for 3 minutes. The slurry was diluted with water of the prescribed pH and hardness to a pulp consistency of 0.25%, a cationic retention aid was added as required. The mixture was agitated further for 1 minute, diluted to the concentration of 0.025%, and finally made into paper (wet web) on a Noble and Wood papermaking machine.

The wet web obtained was pressed to the solid content of 40%, and dried on a drum drier at 100° C. for 60 seconds. The thus obtained sheet of paper was conditioned at the constant temperature of 20° C. under the constant relative humidity of 60% for 24 hours, and used as a paper sample (having the basis weight of 65 g/m$^2$) for test. Sizing performance was evaluated by Stökigt test. Results are shown in Table 1 together with the conditions employed.

TABLE 1

| Test Run No. | 1 | 2 | 3 | 4 | 5 | 6 |
|---|---|---|---|---|---|---|
| Slurry Conditions | | | | | | |
| Water hardness (ppm) | 100 | 100 | 100 | 1500 | 1500 | 1500 |
| Running pH | 4.5 | 6.5 | 6.5 | 4.5 | 6.5 | 6.5 |

TABLE 1-continued

| Test Run No. | 1 | 2 | 3 | 4 | 5 | 6 |
|---|---|---|---|---|---|---|
| % Sizing agent | 0.5 | 0.5 | 0.5 | 0.5 | 0.5 | 0.5 |
| % Aluminium sulfate | 2.0. | 0.3 | 0.3 | 2.0 | 0.3 | 0.3 |
| % Retention aid (*1) | — | — | 0.02 | — | — | 0.02 |
| Sizing Degree (sec.) | | | | | | |
| Example 1 | 26 | 25 | — | 22 | 20 | — |
| 2 | 26 | 26 | — | 23 | 20 | — |
| 3 | 27 | 25 | — | 23 | 20 | — |
| 4 | 22 | 19 | — | 21 | 20 | — |
| 5 | 22 | 21 | — | 21 | 20 | — |
| 6 | 23 | 21 | — | 21 | 19 | — |
| 7 | 22 | 20 | — | 21 | 20 | — |
| 8 | 23 | 21 | — | 22 | 21 | — |
| 9 | 21 | 22 | — | 20 | 19 | — |
| 10 | 23 | 25 | — | 24 | 21 | — |
| 11 | 23 | 23 | — | 23 | 20 | — |
| 12 | 16 | 16 | — | 15 | 14 | — |
| 13 | 9 | 10 | — | 8 | 9 | — |
| Control Example 1 | 20 | 2 | 12 | 13 | <1 | 10 |
| 2 | 21 | 4 | 18 | 15 | 1 | 13 |

Note
(*1) Retention aid: Kymene 557H supplied by DIC-Hercules, Inc.

As seen from Table 1, the conditions of Run No. 2 were the same as those of Run No. 3, except that the retention aid was not employed in Run No. 2. Likewise the conditions of Run No. 5 were the same as those of Run No. 6 except that the retention aid was not employed in Run No. 5. Table 1 reveals that the sizing agents of Examples according to the invention containing no retention aid exhibit sizing level comparable to or much better than that of the sizing agents of Control Examples containing a retention aid. This fact means that the rosin emulsions of the present invention are excellent in sizing performance and reduce papermaking cost.

TEST 2

A mixture of bleached kraft pulp (1:4 mixture of soft wood pulp and hard wood pulp) and a prescribed amount of coated brokes was beated to the Canadian standard freeness of 350 ml with water having the hardness of 50 ppm in an amount to provide a pulp slurry of a pulp consistency of 2.5% by weight at a prescribed temperature.

The slurry (1.2 liters) was taken in a size crock, a prescribed amount of a sizing agent to be tested and aluminum sulfate were simultaneously added to the slurry. The slurry was adjusted to a prescribed pH and agitated for 3 minutes. In some cases, these procedures were carried out at prescribed elevated temperature. Then the slurry was diluted with water of the hardness of 50 ppm and of a prescribed pH and temperature to the pulp consistency of 0.025%. Using the thus obtained pulp slurry, paper was prepared by a Noble and Wood papermaking machine and tested as in Test 1. Results are shown in Table 2 together with the conditions employed.

TABLE 2

| Test Run No. | 1 | 2 | 3 | 4 |
|---|---|---|---|---|
| Sizing Conditions | | | | |
| Content of coated brokes (%) (*1) | 0 | 0 | 10 | 20 |
| Running pH | 5.0 | 5.0 | 6.1 | 6.8 |
| Running temperature (°C.) | Room temp. | 40 | Room temp. | Room temp. |
| % Sizing agent | 0.5 | 0.5 | 0.5 | 0.5 |
| % Aluminium sulfate | 1.5 | 1.5 | 1.5 | 1.5 |
| Sizing Degree (sec.) | | | | |
| Example 1 | 24 | 25 | 23 | 20 |

TABLE 2-continued

| Test Run No. | 1 | 2 | 3 | 4 |
|---|---|---|---|---|
| 2 | 25 | 25 | 24 | 21 |
| 3 | 25 | 25 | 23 | 20 |
| 4 | 22 | 20 | 20 | 19 |
| 5 | 23 | 21 | 23 | 21 |
| 6 | 23 | 22 | 21 | 21 |
| 7 | 23 | 20 | 24 | 20 |
| 8 | 24 | 22 | 24 | 22 |
| 9 | 21 | 19 | 19 | 20 |
| 10 | 22 | 21 | 20 | 22 |
| 11 | 21 | 20 | 21 | 22 |
| Control Example 1 | 15 | 11 | 10 | 2 |
| 2 | 17 | 13 | 15 | 5 |
| 3 | 20 | 17 | 21 | 16 |
| 4 | 14 | 9 | 13 | 5 |

Note
(*1) $CaCO_3$ content of 10%

EVALUATION OF STORAGE AND MECHANICAL STABILITY OF ROSIN EMULSION SIZING AGENTS

Each of the rosin emulsion sizing agents prepared in Examples and Control Examples was tested for its storage stability and mechanical stability. Procedures and conditions employed were as follows.

TEST 3

Each sizing agent in an amount to provide 30 g of solid was placed in a vertical glass tube having the inner diameter of 23 mm and allowed to stand for 6 months. At the end of the period, the height of settled sediment was compared with each other.

TEST 4

Fifty (50) grams of each sizing agent was placed in a Marlon test vessel, and treated with rotation of 1000 rpm for 5 minutes under the pressure of 10 kg. After the treament the sample was removed from the vessel, and filtered through a filter cloth of 250 mesh. The weight of the filtration residue on the dry basis was determined, and the percentage thereof, based on the total solid content of the emulsion, was calculated.

TEST 5

Two hundred (200) grams of each sample was recirculated by means of a roller pump through a passage equipped with a screen of 250 mesh for 30 minutes. At the end of the period, the weight of the agglomerate accumulated on the screen was determined, and the parts per million value of said weight based on the weight of the total solid content of the emulsion was calculated.

Results are shown in Table 3.

TABLE 3

| | Test 3 (mm) | Test 4 (%) | Test 5 (ppm) |
|---|---|---|---|
| Example 1 | 0.3 | 0.3 | 25 |
| 2 | 0.2 | 0.2 | 20 |
| 3 | 0.3 | 0.2 | 22 |
| 4 | 0.5 | 0.5 | 53 |
| 5 | 0.5 | 0.3 | 45 |
| 6 | 0.6 | 0.5 | 52 |
| 7 | 0.4 | 0.3 | 47 |
| 8 | 0.5 | 0.5 | 44 |
| 9 | 0.6 | 0.3 | 45 |
| 10 | 0.4 | 0.3 | 37 |
| 11 | 0.4 | 0.4 | 41 |
| 12 | 0.6 | 0.4 | 52 |
| 13 | 0.6 | 0.5 | 57 |

TABLE 3-continued

| | Test 3 (mm) | Test 4 (%) | Test 5 (ppm) |
|---|---|---|---|
| Control Example 1 | 0.7 | 1.2 | 91 |
| 2 | 0.5 | 1.0 | 85 |
| 3 | 0.9 | 0.8 | 63 |
| 4 | 4.5 | 4.2 | 254 |

We claim:

1. A rosin emulsion sizing agent consisting essentially of, by weight, (1) from 20 to 50% of a fortified rosin, (2) from 1 to 30% of a partially or totally quaternized, cationized product of a copolymer consisting essentially of:

a. from 20 to 80% by weight of (a.1) a (meth)acrylic acid alkyl ester monomer of the general formula (I):

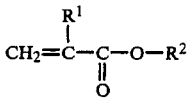

(I)

wherein $R^1$ is H or $CH_3$, and $R^2$ is one member selected from the group consisting of $C_{1-18}$ alkyls, or of (a.2) a styrene monomer of the general formula (II):

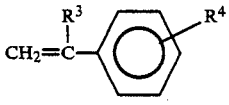

(II)

wherein $R^3$ is H or $CH_3$, and $R^4$ is H or $C_{1-4}$ alkyls, or of (a.3) both said (meth)acrylic acid alkyl ester monomer of general formula (I) and said styrene monomer of general formula (II); and b. from 20 to 80% by weight of a (meth)acrylic acid alkylaminoalkyl ester or amide monomer of the general formula (III)

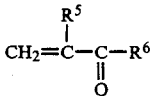

(III)

wherein $R^5$ is H or $CH_3$, and $R^6$ is mono- or di-lower-alkylamino-lower alkoxy or mono- or di-lower-alkylamino-lower alkylamino; said copolymer having a number average molecular weight of from 1,000 to 500,000; and (3) the balance being water.

2. The sizing agent in accordance with claim 1, wherein the substituent $R^2$ of the (meth)acrylic acid alkyl ester (2)a is selected from $CH_3$, $C_2H_5$, $C_3H_7$, $C_4H_9$, $C_8H_{17}$, $C_{12}H_{25}$ and $C_{18}H_{37}$;

the substituent $R^4$ of the styrene compound (2)a is selected from H, $CH_3$, $CH(CH_3)_2$ and $C(CH_3)_3$; and the substituent $R^6$ of the (meth)acrylic acid alkylaminoalkyl ester or amide monomer (2)b is selected from $-O(CH_2)_nN(CH_3)_2$, $-O(CH_2)_nN(C_2H_5)_2$, —$NH(CH_2)_nN(CH_3)_2$, and —$NH(CH_2)_nN(C_2H_5)_2$, wherein n is an integer of 1–6.

3. The sizing agent in accordance with claim 1, wherein the degree of quarternization of said copoymer is from 50 to 100%.

4. The sizing agent in accordance with claim 3, wherein the degree of quarternization of said copolymer is from 60 to 100%.

5. The sizing agent in accordance with claim 1, wherein said copolymer has a molecular weight of from 1,000 to 100,000; and consists essentially of from 25 to 75% by weight of the (meth)acrylic acid alkyl ester or the styrene compound or both, and from 25 to 75% by weight of (meth)acrylic acid alkylaminoalkyl ester or amide.

6. The sizing agent in accordance with claim 5, wherein said copolymer has a molecular weight of from 1,000 to 50,000; and consists essentially of from 30 to 70% by weight of the (meth)acrylic acid alkyl ester or the styrene compound or both, and from 30 to 70% by weight of (meth)acrylic acid alkylaminoalkyl ester or amide.

7. The sizing agent in accordance with claim 1, which contains from 25 to 45% by weight of the fortified rosin (1) and from 2 to 20% by weight of the cationized copolymer (2).

8. The sizing agent in accordance with claim 7, which contains from 25 to 45% by weight of the fortified rosin (1) and from 2 to 10% by weight of the cationized copolymer (2).

9. A rosin emulsion sizing agent consisting essentially of by weight, (1) from 20 to 50% of a fortified rosin, (2) from 1 to 30% of a partially or totally quaternized, cationized product of a copolymer consisting essentially of:

a. from 20 to 80% by weight of (a.1) a (meth)acrylic acid alkyl ester monomer of the general formula (I)

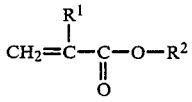

(I)

wherein $R^1$ is H or $CH_3$, and $R^2$ is one member selected from the group consisting of $C_{1-18}$ alkyls, or of (a.2) a styrene monomer of the general formula (II)

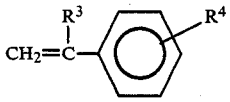

(II)

wherein $R^3$ is H or $CH_3$, and $R^4$ is H or $C_{1-}$alkyls, or of (a.3) both said (meth)acrylic acid alkyl ester monomer of general formula (I) and said styrene monomer of general formula (II); and b. from 20 to 80% by weight of a (meth)acrylic acid alkylaminoalkyl ester or amide monomer of the general formula (III):

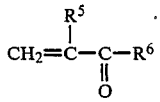

(III)

wherein $R^5$ is H or $CH_3$, and $R^6$ is mono- or di-lower-alkylamino-lower alkoxy or mono- or di-lower-alkylamino-lower alkylamino; and c. from 50 to 20% by weight of a fourth compound of the general formula (IV)

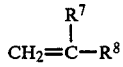

(IV)

wherein $R^7$ is H or $CH_3$ and $R^8$ is CN, lower alkylcarboxy of the formula —$OCOR^{15}$ wherein $R^{15}$ is $C_{1-16}$ alkyls, carbamoyl, mono- or dialkylaminocarboxy of the formula $CONR^{16}R^{17}$, wherein $R^{16}$ is H or $C_{1-2}$ alkyls and $R^{17}$ is $C_{1-2}$ alkyls, or hydroxy-lower alkoxycarbonyl of the formula $COOR^{18}OH$ wherein $R^{18}$ is $C_{1-6}$ alkylenes; said copolymer having a number average molecular weight of from 1,000 to 500,000; and (3) the balance being water.

10. The sizing agent in accordance with claim 9, wherein the substituent $R^2$ of the (meth)acrylic acid alkyl ester (2)a is selected from $CH_3$, $C_2H_5$, $C_3H_7$, $C_4H_9$, $C_8H_{17}$, $C_{12}H_{25}$ and $C_{18}H_{37}$;

the substituent $R^4$ of the styrene compound (2)a is selected from H, $CH_3$, $CH(CH_3)_2$ and $C(CH_3)_3$;

the substituent $R^6$ of the (meth)acrylic acid alkylaminoalkyl ester or amide monomer (2)b is selected from —$O(CH_2)_nN(CH_3)_2$, —$O(CH_2)_nN(C_2H_5)_2$, —$NH(CH_2)_nN(CH_3)_2$, and —$NH(CH_2)_nN(C_2H_5)_2$, wherein n is an integer of 1–6, and the substituent $R^8$ of the fourth vinyl compound (2)c is selected from CN, —$CONH_2$, —$CONHCH_3$, —$CON(CH_3)_2$ and —$COOCH_2CH_2OH$.

11. The sizing agent in accordance with claim 9, wherein the degree of quarternization of said copolymer is from 50 to 100%.

12. The sizing agent in accordance with claim 11, wherein the degree of quarternization of said copolymer is from 60 to 100%.

13. The sizing agent in accordance with claim 9, wherein said copolymer has a molecular weight of from 1,000 to 100,000; and consists essentially of from 25 to 75% by weight of the (meth)acrylic acid alkyl ester or the styrene compound or both from 25 to 75% by weight of (meth)acrylic acid alkylaminoalkyl ester or amide and from 5 to 20% by weight of the vinyl compound.

14. The sizing agent in accordance with claim 9, wherein said copolymer has a molecular weight of from 1,000 to 50,000; and consists essentially of from 30 to 70% by weight of the (meth)acrylic acid alkyl ester or the styrene compound or both, and from 30 to 70% by weight of (meth)acrylic acid alkylaminoalkyl ester or amide and from 5 to 10% by weight of the vinyl compound.

15. The sizing agent in accordance with claim 9, which contains from 25 to 45% by weight of the fortified rosin (1) and from 2 to 20% by weight of the cationized copolymer (2).

16. The sizing agent in accordance with claim 15, which contains from 25 to 45% by weight of the fortified rosin (1) and from 2 to 10% by weight of the cationized copolymer (2).

* * * * *

UNITED STATES PATENT AND TRADEMARK OFFICE

CERTIFICATE OF CORRECTION

PATENT NO. : 4,943,608

DATED : July 24, 1990

INVENTOR(S) : Mizunori Takahashi,et al

It is certified that error appears in the above-indentified patent and that said Letters Patent is hereby corrected as shown below:

Column 18, line 10, the number "50" should read --5-20%--.

Signed and Sealed this

Twelfth Day of April, 1994

Bruce Lehman

*Attest:*

BRUCE LEHMAN

*Commissioner of Patents and Trademarks*

*Attesting Officer*